US005179595A

United States Patent [19]

Pollet et al.

[11] Patent Number: 5,179,595

[45] Date of Patent: Jan. 12, 1993

[54] ELECTRODYNAMIC-FLUIDIC TRANSDUCER ELEMENT FOR PNEUMATIC LOUDSPEAKER

[75] Inventors: Ferdinand Pollet, Nanterre; Jean Julia, Epinay-sur-Seine, both of France

[73] Assignee: Bertin & Cie, Plaisir Cedex, France

[21] Appl. No.: 659,418

[22] PCT Filed: Sep. 28, 1989

[86] PCT No.: PCT/FR89/00498

§ 371 Date: Mar. 13, 1991

§ 102(e) Date: Mar. 13, 1991

[87] PCT Pub. No.: WO90/03708

PCT Pub. Date: Apr. 5, 1990

[30] Foreign Application Priority Data

Sep. 29, 1988 [FR] France ..... 88 12734

[51] Int. Cl.[5] ..... H04R 25/00

[52] U.S. Cl. ..... 381/165; 381/156; 381/114; 381/194

[58] Field of Search ..... 381/165, 194, 156, 153, 381/189, 114, 199; 29/594, 609.1

[56] References Cited

U.S. PATENT DOCUMENTS 3,073,916 1/1963 Williams et al. .
3,674,945 7/1972 Hands ..... 381/153
4,055,233 10/1977 Huntress ..... 381/187
4,696,045 9/1987 Rosenthal ..... 381/189
5,054,080 10/1991 Julia et al. ..... 381/194

FOREIGN PATENT DOCUMENTS 0012070 6/1980 European Pat. Off. ..... 381/156
2572615 5/1986 France ..... 381/156

OTHER PUBLICATIONS

Webster New Collegiate Dictionary, p. 808.

*Primary Examiner*—Jin F. Ng
*Assistant Examiner*—Le: Huyen D.
*Attorney, Agent, or Firm*—Watson, Cole, Grindle & Watson

[57] ABSTRACT

The support (17) forming the element has a diameter of a magnitude order higher than its height which is itself of a magnitude order higher than its thickness. It is rigidified by means of two membranes each formed of a composite collar including, between the support (17) and a concentric rigid crown (23, 24), an elastomer ring (22) adhered thereto and presenting an axial height of the same order of magnitude as its radial thickness. These rings provide, on the one hand, for the elastic return of the support in axial displacement and, on the other hand, for the preservation of the circularity and therefore for the inherent flatness of said support.

6 Claims, 2 Drawing Sheets

ELECTRODYNAMIC-FLUIDIC TRANSDUCER ELEMENT FOR PNEUMATIC LOUDSPEAKER

The invention relates to a moveable assembly for the composite electrodynamic and fluidic transducer of a pneumatic loudspeaker, comprising an axially moveable tubular support, one end of which carries the coil moveable in the annular air gap of the electrodynamic stage of the transducer and the other end of which forms a nose moveable in the neck of an annular contraction of the fluidic stage of the transducer, the middle part of the said support being gripped between two concentric diaphragms separating the electrodynamic and fluidic stages of the transducer.

The Patents FR-A-2,442,565 and 2,572,615 make known a pneumatic loudspeaker, in which a moveable assembly with an electromagnetic coil is extended by a fluid modulator consisting of a nose which moves in the air flow passage. The movement, controlled by the electrodynamic transducer which receives the vocal input signal, modulates the air flow and generates a sound signal amplified in relation to the input signal.

As in any loudspeaker, the reproduction quality of the sound signal depends on the quality of the transducer, that is to say on the inertia and rigidity of the moveable assembly.

In a pneumatic loudspeaker of the above-described type, the nose has to be especially rigid in order to be capable of withstanding the pressure of the fluid which it is intended to control, whilst the moveable assembly of which the modular nose forms part must have a low inertia. These two qualities are contradictory, and therefore because of the forces generated by the air flow to be controlled it was chosen to given preference to the rigidity. The solution therefore involved using a thick coil support, a result of this being a relatively wide air gap and, for a magnet of given dimensions, a lower intensity of the magnetic flux passing through the transducer coil. The pass band and efficiency of such a transducer were unsatisfactory, and therefore the set object of the invention was to improve these characteristics.

In contrast to the first procedure, the aim was to reduce the inertia as much as possible by adopting the only possible solution, namely to minimise the thickness of the support. The result of this was a coil which was very light, but which was especially susceptible to deformation and incapable of ensuring the control of the air flow of the pneumatic circuit with the desired accuracy.

The result of the invention was, among other things, to make the moveable assembly more rigid by using the other elements of the transducer, particularly the annular elastic diaphragm, in such a way that the said diaphragm performs the function of a hoop.

The moveable assembly according to the invention is characterized in that the said support having a diameter of an order of magnitude greater than its height, itself of an order of magnitude greater than its thickness, is made rigid by means of the abovementioned diaphragms, each formed from a composite hoop which, between the support and a concentric rigid ring, includes an elastomeric collar adhering thereto and having an axial height of the same order of magnitude as its radial thickness, in order, on the one hand, to ensure the elastic return of the support in terms of its axial movement and, on the other hand, to maintain the circularity and therefore the planeness of the said support.

The explanations and figures given below by way of example will make it possible to understand how the invention can be put into practice. In these figures, the relative dimensions are not adhered to, in order to obtain greater clarity in the drawing.

Figure 1:
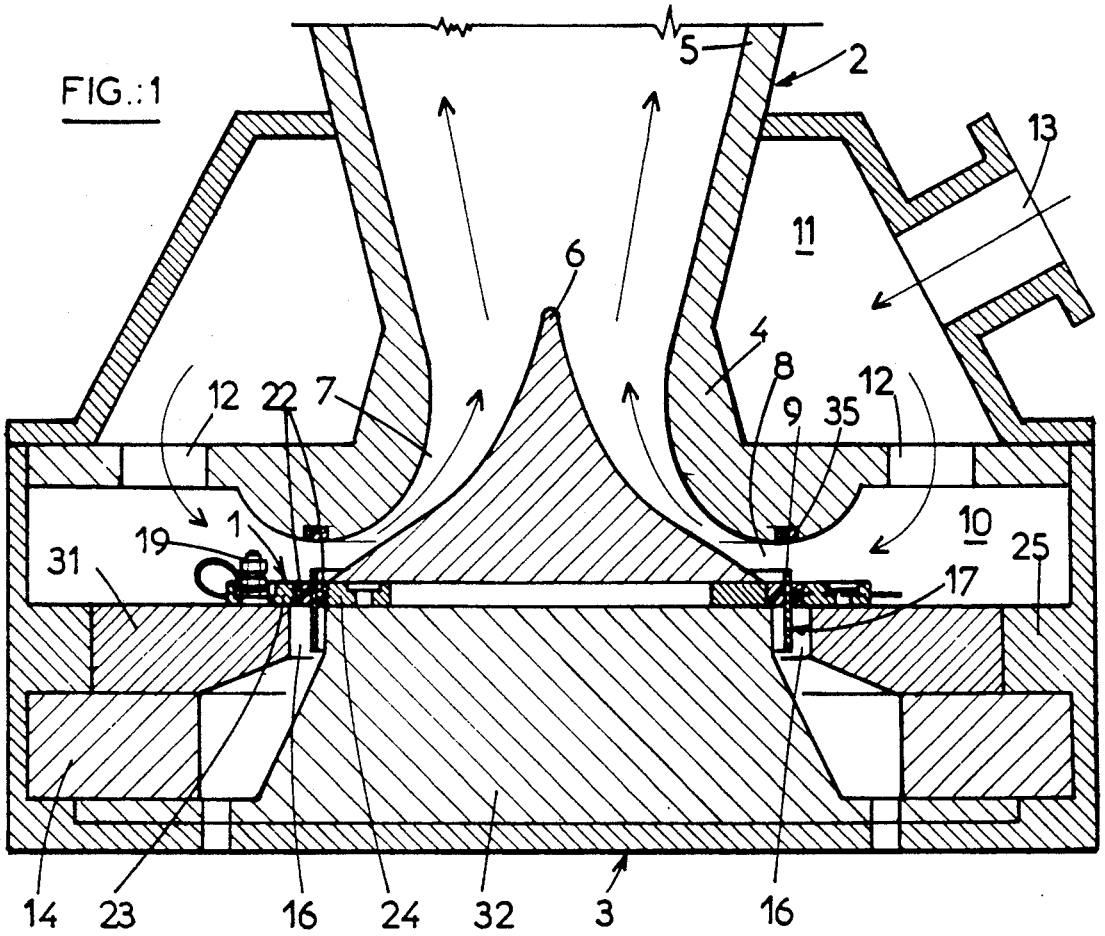
FIG. 1 shows a view in diametral section of a transducer according to the invention mounted in a pneumatic loudspeaker.

In FIG. 1, on either side of a wall 1 can be seen on the one hand the fluidic stage 2 and on the other hand the electrodynamic stage of the transducer 3.

Figure 2:
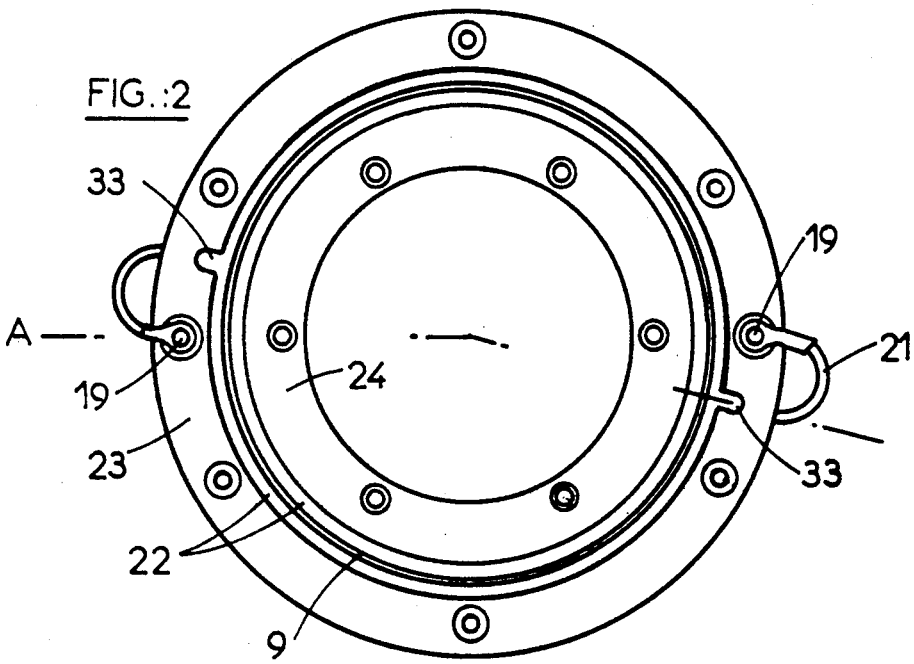
FIG. 2 is a top view of the moveable assembly of the transducer.

The fluidic stage 2 as a whole comprises a nozzle 4 extended by an acoustic horn 5, this nozzle 4 delimiting with a profiled diffuser 6 an annular conduit 7 comprising a neck 8, in the plane of which an annular nose 9 is arranged. Upstream of this neck 8, a cylindrical collector 10 is fed uniformly from a capacity 11 comprising ports 12 distributed uniformly over its base, the said capacity 11 being fed via an intake conduit 13. The moveable nose 9 (see also FIG. 2) consists of the end 17A of the tubular support forming the moveable assembly and is connected to the wall 1 by means of a continuous elastic diaphragm 22. This wall comprises an outer ring 23 and an inner ring 24 which are fastened to the transducer 3 by means of screws. The nose 9 controls the modulation of the advantageously sonic air flow passing through the neck of the fluidic stage.

The transducer 3 consists conventionally of a permanent magnet 14 and of pole pieces 31, 32, delimiting an annular air gap 16, in which the moveable assembly 17 of the electromagnetic coil moves axially.

The transducer is accommodated in a housing 25 fastened to the pneumatic circuit as a whole.

Figure 3:
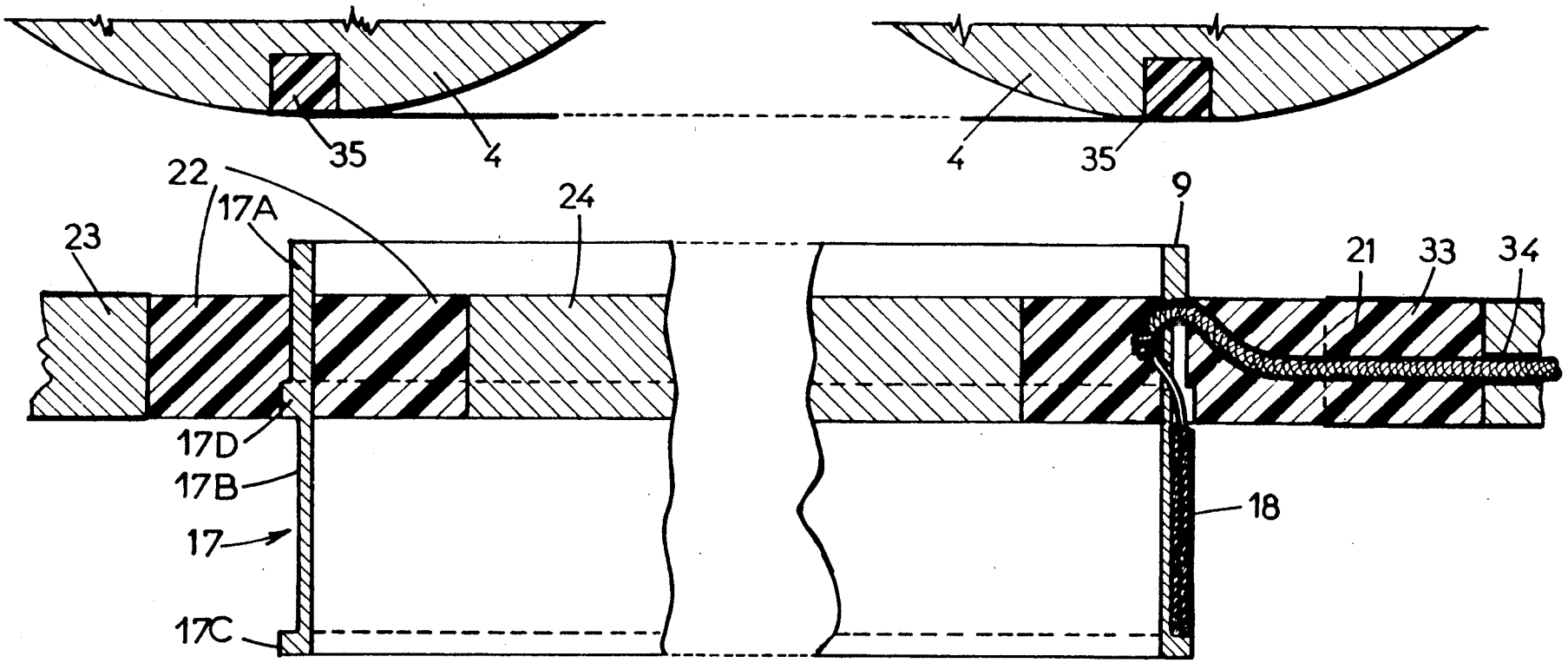
FIG. 3 is a pseudo-diametral section through FIG. 1.

As can be seen better from FIG. 3, this moveable assembly 17 comprises an annular support 17A made, for example, from glass/epoxide fibres and having, on its outer surface, an indentation 17B in the form of a flattened groove, the bottom of which is covered by adhesive (for example of the epoxide type). The turns of the coil 18 are wound in this groove 17B without projecting appreciably relative to the outer surface of the support 17A. The whole is then covered externally with a smooth layer of adhesive (for example, a resin of the ethoxyline type) which embeds the said turns and which forms an integral support/coil unit.

The moveable assembly of the transducer is gripped between two concentric diaphragms, each formed from a composite hoop consisting of a rigid ring 23 or 24 and of an elastomeric collar 22. The elastomeric rings are cast in situ between the support and the rigid rings and adhere thereto.

The in situ casting ensures an effective hooping of the moveable assembly. The shape of the collars and especially the dimensions of their cross-section and the choice of rigidity of the elastomer ensure a high resonant frequency of the moveable assembly. In fact, the elastomer works essentially by shearing, and by adopting the dimensions of the cross-section of the collar of the same order of magnitude the stresses are distributed as efficiently as possible and the appropriate axial rigidity, that is to say of the order of 300 to 1,000 N/mm is obtained. Since the elastomer is incompressible, the ring/collar unit behaves like a double hoop which prevents any circularity defect and consequently prevents any deformation of the plane defined by the nose. The width of the air passage defined between the neck of the nozzle and the nose of the assembly remains constant over the entire circumference for a given position of the assembly.

To make the assembly as light as possible, the thickness of the nose 9 is reduced over at least a part 17A of the end of the support forming the said nose.

According to a preferred embodiment shown in partial section in FIG. 3, an annular elastomeric stop 35 is provided in the nozzle part 4 located opposite the nose 9. The function of this stop is to prevent damage to the nose caused by possible contact between the edge of the nose and the wall of the nozzle and attributable to excessively high dynamics or to suction by the sonic air flow.

The support illustrated in FIG. 3 is separated into two parts by means of a middle rim 17D: the coil of the electromagnetic transducer is accommodated between the said rim 17D and an end rim 17C whilst the nose 9 is formed by the thinned end of the part 17A.

The ends 18 of the coil are connected by means of conductive braids 21 to the supply terminals 19 (FIG. 2) which receive the electrical signal from a chain for the amplification of a sound or suchlike signal.

To give the conductive braids sufficient flexibility, in the inner edge of the outer ring 23 there are diametral indentations 33 (FIG. 2), the bottom of which is pierced with a cylindrical hole 34 half-way in the thickness of the ring.

Arranged in the extension of the hole 34 is a flexible tube, through which the braid 21 passes and which will be coated with the elastomer during the formation of the collars. The tube is preferably made of the same material as that provided for the casting of the collars. Indentations which are likewise lined with elastomer ensure that the electrical connection has greater flexibility. The free part of the braid coming diametrically out of the ring is fastened to the terminals 19 by known means.

According to exemplary embodiments of the transducer assembly, the latter has the following dimensions: inside diameter of the support: #102 mm; height of the collar: #16 mm; thickness of the part forming the modulator nose: #1.5 mm.

As can easily be seen, there is an order of magnitude between the height and diameter of the moveable assembly and likewise an order of magnitude between its height and its thickness.

The large diameter of the support is made necessary by the considerable fluid flow which is of the order of several tens of grammes per second at pressures of 2 to 3 bars and which passes through the fluidic amplifier.

Because lightness is sought after, the support is especially flexible, and retaining it in a conventional thin diaphragm cannot result in making it sufficiently rigid. The in situ casting of thick elastomeric collars made integral with the outer and inner rings and the support makes it possible to ensure effective hooping of the latter. The width of the collars is at least of the same order of magnitude as their thickness and, according to one exemplary embodiment, is of the thickness of the rings (approximately 4 mm).

The casting product used is a commercial silicone elastomer vulcanizing at ambient temperature and of a Shore A hardness of the order of 40 within a temperature range of −70° to +200° C. This temperature range is selected so that the material preserves its hardness characteristics and consequently there are no changes in the characteristics of the loudspeaker, whatever the variations of the surrounding temperature or of the temperature of the air feeding the pneumatic circuit.

The operation of casting the collars 22 between the support and the rings 23 and 24 is conducted successfully because they are held by suitable templates which ensure the appropriate positioning of the various elements.

The high rigidity of the chosen elastomer ensures a high resonant frequency and therefore a relatively extensive pass band and a useful signal-to-noise ratio, that is to say of the order of 30 to 40 dB.

The resonant frequencies can be selected by varying the cross-section of the collars and/or the hardness of the elastomer. Thus, for dimensions of the elastomeric collars of 4 mm, the resonant frequency is 1200 Hz. For double the width, it is 800 Hz.

The pneumatic loudspeaker comprising a moveable assembly according to the invention allows the passage of a frequency band of 5 KHz, thus guaranteeing very high word comprehension.

We claim:

1. Movable assembly for the composite electrodynamic and fluidic transducer of a pneumatic loudspeaker, comprising an axially movable tubular support, one end of which carries the coil movable in the annular air gap of the electrodynamic stage of the transducer and the other end of which forms a nose movable in the neck of an annular contraction of the fluidic stage of the transducer, a nozzle part located opposite the movable nose and including an annular elastomeric stop, the middle part of said support being gripped between two concentric diaphragms separating the electrodynamic and fluidic stages of the transducer, said support having a diameter of an order of magnitude greater than its height, said height being of an order of magnitude greater than the thickness of said support, is made rigid by means of said diaphragms, each formed from a composite hoop which, between said support and a concentric rigid ring, includes an elastomeric collar, adhering thereto and having an axial height of the same order of magnitude as its radial thickness, in order, on the one hand, to ensure the elastic return of the support in terms of its axial movement and, on the other hand, to maintain the circularity and therefore maintaining said nose of said support in a plane.

2. Assembly according to claim 1, wherein said elastomeric collars are cast in situ between the support and the rings held by means of suitable templates.

3. Movable assembly according to claim 2, wherein the elastomer encases two flexible tubes extending through the support and the outer ring, in order to allow passage for the connections of the movable coil.

4. Movable assembly according to claim 3, wherein the ring comprises, in line with each connection, an indentation which is filled with the elastomer and through which the tube is extended.

5. Moveable assembly according to claim 2, wherein the elastomer is a silicone vulcanizable at ambient temperature.

6. Moveable assembly according to claim 2, wherein the elastomer has a Shore A hardness of the order of 40 over a temperature range of −70° to +200° C.

* * * * *